US011097280B2

(12) United States Patent
Dijsselbloem et al.

(10) Patent No.: US 11,097,280 B2
(45) Date of Patent: Aug. 24, 2021

(54) CUTTING MODULE AND METHOD FOR CUTTING A STRAND INTO INDIVIDUAL PIECES

(71) Applicant: SABIC GLOBAL TECHNOLOGIES B.V., Bergen op Zoom (NL)

(72) Inventors: Willy Joseph Dijsselbloem, Geleen (NL); Stefan Gielen, Geleen (NL); Jose Sales-Fernandez, Geleen (NL)

(73) Assignee: SABIC GLOBAL TECHNOLOGIES B.V., Bergen op Zoom (NL)

( * ) Notice: Subject to any disclaimer, the term of this patent is extended or adjusted under 35 U.S.C. 154(b) by 190 days.

(21) Appl. No.: 16/318,934

(22) PCT Filed: Jul. 10, 2017

(86) PCT No.: PCT/EP2017/067281
§ 371 (c)(1),
(2) Date: Jan. 18, 2019

(87) PCT Pub. No.: WO2018/015198
PCT Pub. Date: Jan. 25, 2018

(65) Prior Publication Data

US 2019/0193086 A1 Jun. 27, 2019

(30) Foreign Application Priority Data

Jul. 18, 2016 (EP) ..... 16179912

(51) Int. Cl.
*B02C 18/14* (2006.01)
*B02C 18/18* (2006.01)
*B26D 1/40* (2006.01)

(52) U.S. Cl.
CPC ..... *B02C 18/144* (2013.01); *B02C 18/18* (2013.01); *B02C 18/186* (2013.01); *B26D 1/40* (2013.01)

(58) Field of Classification Search
CPC ... B02C 18/144; B02C 18/186; B02C 18/145; B02C 18/18; B26D 1/40
See application file for complete search history.

(56) References Cited

U.S. PATENT DOCUMENTS 3,265,482 A * 8/1966 Langlois ..... F16J 1/00 65/505
3,644,109 A * 2/1972 Klink ..... C03B 37/16 65/536

(Continued)

FOREIGN PATENT DOCUMENTS

CN 105170251 A 12/2015
DE 4336955 A1 * 5/1995 ..... B26D 1/385

(Continued)

OTHER PUBLICATIONS

X- and Y-Components, Force Vector, retrieved date Sep. 9, 2020.*

(Continued)

*Primary Examiner* — Adam J Eiseman
*Assistant Examiner* — Mohammed S. Alawadi
(74) *Attorney, Agent, or Firm* — Cantor Colburn LLP

(57) ABSTRACT

A cutting module for cutting a strand into individual pieces, the cutting module comprising a rotatable cutter wheel and a rotatable cot wheel, the cutter wheel being rotatable and having cutting blades, the cot wheel having a cylindrical outer surface and being rotatable parallel at a distance from the cutter wheel, such that cutting edges of the cutting blades contact the outer surface of the cot wheel successively in use, so that a strand which is fed between the cutter wheel and the cot wheel is cut into individual pieces, each of the cutting blades being designed such that a cutting force is directed through the cutting blade.

16 Claims, 5 Drawing Sheets

(56) References Cited

U.S. PATENT DOCUMENTS

| | | | |
|---|---|---|---|
| 4,249,441 | A | 2/1981 | Sturtz |
| 2010/0189519 | A1 | 7/2010 | Kerf |

FOREIGN PATENT DOCUMENTS

| | | | |
|---|---|---|---|
| EP | 1920846 | A1 | 5/2008 |
| NL | 1031531 | C1 | 4/2006 |
| WO | 9806551 | | 2/1998 |
| WO | 2009080281 | A1 | 7/2009 |

OTHER PUBLICATIONS

English translate (DE4336955A1), retrieved date May 25, 2021.*
International Search Report; International Application No. PCT/EP2017/067281; International Filing Date: Jul. 10, 2017; dated Jan. 16, 2018; 5 pages.
Written Opinion; International Application No. PCT/EP2017/067281; International Filing Date: Jul. 10, 2017; dated Jan. 16, 2018; 10 pages.

* cited by examiner

CUTTING MODULE AND METHOD FOR CUTTING A STRAND INTO INDIVIDUAL PIECES

CROSS REFERENCE TO RELATED APPLICATIONS

This application is a 371 of International Application No. PCT/EP2017/067281, filed Jul. 10, 2017, which is incorporated herein by reference in its entirety, and which claims priority to EP Application Serial No. 16179912.7, filed Jul. 18, 2016.

TECHNICAL FIELD

The present teachings relate to a cutting module and a method for cutting a strand into individual pieces, the individual pieces also being referred to as "granules", or, "pellets". The present teachings in particular relate to a cutting module and a method for cutting a strand of long glass fibre reinforced thermoplastic polymer composition having a core comprising a continuous glass multifilament strand and a sheath surrounding said core. The cutting module has a cutter wheel and a cot wheel, the cutter wheel having a plurality of cutting blades.

BACKGROUND

US2010/0189519 A1 recites a rotary cutting tool with knives or blades for cutting a material in a thread into granules before using it as a raw material. A drawback of this known system is that the blades of the cutting tool wear out relatively fast.

EP 1 920 846 A1 relates to a rotary cutting tool having a knife in the form of a first rotating cylinder provided with several cutting blades in engagement with a second cylinder, the cylinders rotating in opposite directions and cooperating for cutting a material in the form of a thread into granules. There is room for improvement of the durability of the cutting blades.

Long glass fibre reinforced thermoplastic polymer compositions are generally prepared by a sheathing or wire-coating process, by crosshead extrusion or several pultrusion techniques. Using these technologies, impregnated or coated fibre strands are formed. These may then be cut into lengths, the pellets or granules thus obtained being suitable for further processing, i.e. for injection moulding and compression moulding as well as for extrusion compression moulding processes, into (semi)-finished articles. Long glass fibre-reinforced polymer compositions contain glass fibres having a length of at least 5 mm and preferably between 5 and 40 mm. As a result, glass fibres in moulded articles made from long glass fibre-reinforced polymer compositions generally are of higher length than in articles made from short glass fibre compositions, resulting in better mechanical properties.

An object of the present invention is to provide a cutting module for cutting strands, wherein the cutting blades of a cutter wheel of such a module last longer. Said object of the present invention is achieved by the various aspects of the present invention.

SUMMARY

In a first aspect, the invention relates to a cutting module according to claim 1, for cutting a strand into individual pieces, the cutting module comprising a rotatable cutter wheel and a rotatable cot wheel; the cutter wheel being rotatable about a cutter wheel central rotational axis, and having a plurality of cutting blades, spaced apart in circumferential direction of the cutter wheel and each extending in an axial direction, each of the plurality of cutting blades having a front surface, facing forward in a direction of rotation of the cutter wheel in use, and a rear surface, at an acute tip angle with the front surface, facing rearward in the direction of rotation in use, an intersection of the front and rear surfaces defining a cutting edge; the cot wheel having a cylindrical outer surface and being rotatable about a cot wheel central rotational axis extending parallel at a distance from the cutter wheel rotational axis, such that the plurality of cutting edges of the cutting blades contact the outer surface of the cot wheel successively in use, so that a strand which is fed between the cutter wheel and the cot wheel is cut into individual pieces; each of the plurality of cutting blades being designed such that a cutting force is directed through the cutting blade.

Definitions

The following definitions are used in the present description and claims to define the stated subject matter.

- "strand" means a material in the form of a thread.
- "multifilament strand" means a bundle of threads or filaments, this is an unsheathed strand.
- "composite strand" and "sheathed multifilament strand" are a bundle of threads or filaments surrounded by a thermoplastic polymer sheath. These two terms are used interchangeably throughout the present description and claims.
- "cot wheel" means a counter wheel for the cutter wheel, supporting the strand to be cut by cutting blades of the cutter wheel in use. The cot wheel has a radius (r_cow).
- "tip angle" (t) means the acute angle between the relevant parts of the front and rear surfaces of a cutting blade, defining the cutting edge at the intersection thereof. The relevant parts of the front and rear surfaces are the parts in vicinity of the cutting edge, in the range up to 1 mm, or 2 mm, or 3 mm from the cutting edge. In use the relevant parts of the front and rear surfaces are preferably at least equal to the thickness of the composite strand to be cut.
- "angle bisector line" (ab) means a mathematical, or, virtual line which divides an angle into two equal halves. In the present teachings and for a cutting blade, the relevant angle is the acute tip angle between a front and rear surface of a cutting blade, the front surface facing forward in a direction of rotation of the cutter wheel and the rear surface facing rearward in the direction of rotation of the cutter wheel.
- "cutting edge radius" (r_ce), means the distance between the cot wheel central rotational axis and the cutting edge. This radius is thus dependent on the depth of the cut at a certain moment. Also r_ce at the start of the cut, that means at the entry point, is equal to the sum of r_cow and t_s.
- "cutting force" (Fc) means a force at the cutting edge of a cutting blade in use, while the cutting blade cuts through the strand. The cutting force has a direction substantially perpendicular to the strand. That means, in the present teachings at least the cutting force component perpendicular to the strand and thus also to the cot wheel surface at the location of the cutting edge is the relevant force. The cutting force direction coincides with a virtual line (a) intersecting the cot wheel rotational axis and the cutting edge, since the strand lies against the outer surface of the cot wheel at least at the location of the cutting.

"forward angle" (f) means the angle over which a cutting blade points forward in the direction of rotation of the cutter wheel in use. The forward angle is the acute angle between the angle bisector line (ab) of the tip angle (t) of a cutting blade and a mathematical base line (b) intersecting the rotational axis of the cutter wheel and the cutting edge.

DETAILED DESCRIPTION OF THE INVENTION

As discussed above, in a first aspect, the invention relates to a cutting module according to claim 1. Each of the plurality of cutting blades has been designed based on predetermined values for the cot wheel radius, the cutter wheel radius, a penetration depth if any, and a strand diameter or thickness, or at least based on values related to said values such as wheel diameters instead of radii, such that a cutting force is directed through the cutting blade.

It was found by the inventors that the durability of the cutting blades is improved when the cutting force is directed through the cutting blades at all times during a cut through the strand in use, that means from entry of the cutting blade into the strand until exit of that cutting blade from the strand. As a result of the increased durability, because the cutting blades are less prone to wear and damage, the uptime of the cutting module is significantly increased, leading to relevant cost savings. The strand may further be cut with a relatively high quality cutting surface, at higher speeds. An increased cut quality, i.e. a cut with a relatively high quality cutting surface, is associated with less waste (of the strand), in case of glass fiber reinforcement increased cut quality also reduces the production of glass splinters/dust, so called "free glass" which is hazardous. These effects occur in particular with the use of strands of long glass fibre reinforced polypropylene having a core comprising a continuous glass multifilament strand and a sheath of a thermoplastic, such as said polypropylene, surrounding said core.

It is noted that WO2009/080281 relates to a process for producing a long glass fibre-reinforced thermoplastic polymer composition. In an embodiment of said known process, the process comprises a step of cutting a sheathed continuous glass multifilament strand (viz. the composite multifilament strand) into pellets. Said latter process step may effectively be carried out using the cutting module according to the present teachings as will be discussed in more detail below.

It is further noted that WO98/06551 relates to a method of making a composite product comprising preparing a thermoplastic-encased composite strand material for disposing in a matrix material, and comprising cutting said composite strand into lengths to form a plurality of pellets. Said latter process step may effectively be carried out using the cutting module according to the present teachings as will be discussed in more detail below.

The strand preferably comprises a continuous glass multifilament strand, having a filament density which may vary within wide limits. Preferably, the continuous multifilament strand may have from 500 to 10000 glass filaments/strand and more preferably from 2000 to 5000 glass filaments/strand, because of high throughput.

The diameter of the glass filaments in the continuous multifilament strand may widely vary. Preferably, the diameter of the glass filaments ranges from 5 to 50 microns, more preferably from 10 to 30 microns and most preferably from 15 to 25 microns. Glass filaments diameters outside these ranges tend to result in a decrease of mechanical properties and/or enhanced abrasion of the equipment, such as the cutting module, used. The diameter of the unsheathed multifilament strand is in completely packed modus between 0.5 and 5.0 millimeter, preferably between 1.0 and 3.0 millimeter, such as between 1.2 and 1.8 millimeter. It should be noted that when the multifilament strand is partly unpacked this diameter increases.

In an embodiment, each of the plurality of cutting blades has been designed such that, in use while cutting through a strand, a cutting force is directed through the rear three quarters of the cutting blade. That is, between an angle bisector line of an angle between the front surface of the cutting blade and the angle bisector line of the tip angle of the cutting blade, and the rear surface of the cutting blade. This further increases the durability of the cutting blades.

In an embodiment, each of the plurality of cutting blades has been designed such that a cutting force is directed through the rear half of the cutting blade. That is, between an angle bisector line of the tip angle and the rear surface of the cutting blade. This even further increases the durability of the cutting blades.

In an embodiment, each of the plurality of cutting blades points forward, over a forward angle, in the direction of rotation of the cutter wheel in use. This means that each cutting blade is oriented relative to the rotational axis of the cutter wheel such that at each point along its cutting edge the angle bisector line is at an acute angle with a virtual base line intersecting the rotational axis of the cutter wheel and the cutting edge, wherein the bisector line extends rearward of the base line through the cutting blade. An effect may be that the tip angle of the cutting blades is decreased, which leads to a higher cut quality.

In an embodiment, the forward angle of each of the plurality of cutting blades is, individually, in the range of 3 to 10, preferably of 4 to 8 degrees, more preferably of 5 to 6 degrees, such as about 5.5 degrees. An effect may be that a relatively high cut quality is achieved with a reduced chance of "trains", that means, individual pieces still sticking together after being cut, which is undesirable.

The cutting force may be directed at an acute safety angle of at least one degree, preferably in the range of 0.5 to 2 degrees, with the bisector line as well as with the rear surface of the cutting blade. That means, each of the plurality of cutting blades being designed such that a cutting force is directed through the cutting blade, between an angle bisector line of the tip angle and its rear surface, wherein the cutting force is at an acute safety angle of at least 0.5 degree, preferably in the range of 0.5 to 2 degrees, with the bisector line as well as with the rear surface of the cutting blade. Thus, while a cutting blade cuts through the strand, the cutting force remains clear of the bisector line and the rear surface over a safety angle of at least 0.5 degree. An effect of this redundancy is that deviations such as a deviation in strand thickness or a deviation in cot wheel radius, such as due to wear, can be tolerated to a larger extent.

In an embodiment, a cutter wheel radius, defined by a circumscribed circle of the plurality of cutting blades, that means through the cutting edges thereof, is in the range of 20 to 35 percent of a cot wheel radius, defined by the cylindrical outer surface of the cot wheel, preferably in the range of 23 to 30 percent, further preferably about 27 percent. This is believed to lead to a more optimal cut.

Preferably the cutter wheel radius is in the range of 75 to 85 mm, more preferably about 80 mm. Preferably the cot wheel radius is in the range of 280 to 320 mm, further preferably in the range of 294 to 305 mm, and still further preferably about 300 mm.

The plurality of cutting blades may be spaced apart in circumferential direction of the cutter wheel such that a circular arc between two successive cutting edges is in the range of 5 to 40 mm, preferably in the range of 10 to 30 millimeter, further preferably 12 or 24 millimeter. This results in individual pieces, or, granules, of a length which enables a relatively wide range of use of the granules as raw material such as for injection moulding purposes. Since the multifilament strand used is continuous and since it is surrounded by a continuous polymeric sheath, each individual piece has the following configuration: a core of multifilament strand surrounded by a polymeric sheath. When the composite strand has been cut one or more ends of the filaments of the multifilament core are usually exposed on the cutting surface. The length of the glass fibres in the pellets or granules is typically substantially the same as the granule length. In an embodiment, the pieces are 12 or 24 millimeter comprising a glass multifilament core and a polypropylene homopolymer sheath. In an embodiment, the multifilament strand (including any sizing and/or impregnation) forms between 30 and 70% by mass of the total composite, such as 40% or 50% or 60%, the rest being formed by the polymeric sheath.

The plurality of cutting blades may extend under a slight helical angle with respect to the axial direction and a large helical pitch, that is significantly larger than the length of the cutter wheel. A helical configuration of the cutting blades with respect to the axial direction of the cutter wheel is preferred. Preferably, the plurality of cutting blades form a helical angle preferably in the range of 8 to 14 degrees, more preferably about 11 degrees, with respect to the axial direction. Using such a slight helical angle with respect to the axial direction reduces vibrations of the module in use and thereby reduces the amount of irregularities in the individual pieces, or, pellets, obtained. Also, this increases the durability, or lifetime, of the cutting blades.

In an embodiment the tip angle of the cutting edge may be in the range of 20 to 40, preferably of 25 to 35, preferably of 27 to 32, degrees, more preferably about 30 degrees. Using a tip angle in this range, a cut of sufficient quality in combination with sufficient durability of the cutting blades may be achieved. Also the cutting speed, i.e. rotational speed of the cutter wheel and the cot wheel, may be increased in said range. A too large tip angle results in breaking instead of cutting of the strand.

Preferably the cutting blades have a forward angle of about 5 degrees and have a tip angle of the cutting edges thereof of about 30 degrees. Alternatively the forward angle may be about 6.5 degrees and the tip angle may be about 30 degrees. Alternatively the forward angle may be about 8 degrees and the tip angle may be about 30 degrees.

According to the invention, a cutting module may be provided, for cutting a strand into individual pieces, the cutting module comprising a rotatable cutter wheel and a rotatable cot wheel, the cutter wheel being rotatable about a cutter wheel central rotational axis, and having a plurality of cutting blades, spaced apart in circumferential direction of the cutter wheel and each extending in an axial direction, each of the plurality of cutting blades having a front surface, facing forward in a direction of rotation of the cutter wheel in use, and a rear surface, at an acute tip angle with the front surface, facing rearward in the direction of rotation in use, an intersection of the front and rear surfaces defining a cutting edge, the cot wheel having a cylindrical outer surface and being rotatable about a cot wheel central rotational axis extending parallel at a distance from the cutter wheel rotational axis, such that the plurality of cutting edges of the cutting blades contact the outer surface of the cot wheel successively in use, so that a strand which is fed between the cutter wheel and the cot wheel is cut into individual pieces, wherein, preferably, each of the plurality of cutting blades points forward, over a forward angle (f), in the direction of rotation of the cutter wheel in use, wherein preferably the tip angle is in the above mentioned range of 20 to 40, preferably between 25 to 35, preferably 27 to 32 degrees, wherein preferably the distance between the cutter and cot wheel is chosen such that in use the penetration depth is in the range of 0.3 to 2.5 or in a preferred subrange thereof, wherein preferably the cutter wheel radius is in the range of 25 to 35 percent of the cot wheel radius, or in a preferred subrange thereof, and wherein preferably the cutting blades have a forward angle, the forward angle being in the range of 3 to 10 degrees or an above mentioned preferred subrange thereof.

The cot wheel may have a resilient layer at least at the outer surface. The distance between the cutter wheel rotational axis and the cot wheel rotational axis may be such that the respective cutting edges of the cutting blades of the plurality of cutting blades elastically deform (indent) or even penetrate the resilient layer of the cot wheel in use of the module, during rotation of the cutter wheel and the cot wheel. An effect is an increased durability of the cutting module since cutting blade wear at the cutting edges is reduces. Also, less noise is produced in use. In an embodiment of the cutting module, in use respective cutting edges of the cutting blades may plastically deform (by penetration) the resilient layer of the cot wheel as well.

A penetration depth of the respective cutting edges into the resilient layer of the cot wheel may be in the range of 0.3 to 2.5 mm, preferably in the range of 0.5 to 1 mm, more preferably in the range of 0.6 to 0.8 mm, by setting the distance between the rotational axes of the cutter wheel and the cot wheel smaller, over the mentioned value of the penetration depth, than the addition of the radius of the cutter and of the cot wheel. In case of such a cot wheel having a resilient layer, a too small penetration depth may result in the strand passing through the cutting module without being cut or at least without being completely cut into individual pieces. A large penetration depth increases the wear of the outer layer of the cot wheel.

In case of such a cot wheel having a resilient layer, the cutting force on exit of the cutting blade from the strand, at the end of a cut through the strand, may be defined as the point of first contact between the cutting blade and the cot wheel. In an embodiment, said point of first contact may be defined in a situation when no strand is fed between the cutter and cot wheel.

In an embodiment, at least a part of the cutting blade at the cutting edge, such as up to 1 mm, 2 mm or even 3 mm from the tip, or, cutting edge, may be made of a carbide such as tungsten carbide. The cutting blades may be made of a steel, wherein a part of the cutting blade at the cutting edge may be made of a carbide such as tungsten carbide. In an embodiment, at least a part of the cutting blade at the cutting edge may comprise a ceramic material.

The resilient surface layer of the cot wheel may be made of an elastomeric material, such as an elastomeric polyurethane or a rubber. The thickness of said surface layer is preferably at least a few mm, such as at least 1 mm or 2 mm or 3 mm. In case a penetration depth is used, as explained above, the thickness of said surface layer may at least be equal to the penetration depth, preferably 0.5 mm more than the penetration depth. In an embodiment, the cot wheel may be at least substantially completely made of said elastomeric material. That means that the surface layer in that case extends at least substantially to the rotation axis of the cot wheel.

In a second aspect, the present teachings relate to a method for cutting a strand into individual pieces, using a cutting module according to the first aspect of the present teachings as described above, the method comprising:

counter-rotating the cot wheel and the cutter wheel, feeding the strand between the cutter wheel and the cot wheel, cutting the strand into individual pieces.

In an embodiment, the cutting module and the method are adapted for cutting a strand comprising glass fibre. In an embodiment, the cutting module and the method are adapted for cutting a strand of long glass fibre reinforced polypropylene having a core comprising a continuous glass multifilament strand and a sheath surrounding said core. Thus, in use of the cutting module such strands are cut into individual pieces, or, granules, by the cutting module.

The composite strand may have a diameter in the range of 2.5 and 4.5 millimeter. The composite strand diameter is equal to the strand thickness. The diameter of the multifilament composite strand is preferably between 2.9 and 3.6 millimeter.

In a third aspect, the present invention relates to a method of making a composite product comprising the steps of:

I) preparing a composite strand; and

II) cutting the strand into individual pieces according to the method of the second aspect of the present invention discussed above.

Said composite strand that is prepared in step I) of the method of the third aspect of the invention may be prepared according to several methods. In one embodiment, the strand is prepared by the steps of providing a plurality of glass fibers, then sizing the glass fibers using a sizing composition, then impregnating the glass fibers using an impregnating composition and then sheathing the plurality of glass fibers using a sheathing material. In an other aspect, the strand is prepared by the steps of providing a plurality of glass fibers, then sizing the glass fibers using a sizing composition in a larger amount so that the fibers are preimpregnated, and then sheathing the plurality of glass fibers using a sheathing material.

In an embodiment of said third aspect, the step I) of preparing a composite strand comprises the steps of:

i) providing a plurality of sized continuous fibers, preferably glass-fibers;

ii) applying a sheath of thermoplastic polymer around the sized continuous multifilament strand to form a composite strand, being a sheathed continuous multifilament.

In an embodiment of said third aspect, the step I) of preparing a composite strand comprises the steps of:

i) providing a plurality of continuous fibers, preferably glass-fibers;

ii) applying a sizing composition to coat substantially all of said plurality of fibers provided in step i)

iii) gathering said plurality of sized glass fibers obtained in step ii) to obtain a preimpregnated continuous glass multifilament strand containing between 2 and 25% by mass of said sizing composition wherein the mass % is based on the total mass of the multifilament strand;

iv) applying a sheath of thermoplastic polymer around the preimpregnated continuous multifilament strand to form a composite strand, being a sheathed continuous multifilament.

In an embodiment of said third aspect, the composite strand is a strand, of long glass fibre-reinforced thermoplastic polymer composition, and step I) of preparing a composite strand comprises the subsequent steps of:

a1) unwinding from a package of at least one continuous glass multifilament strand containing at most 2% by mass of a sizing composition wherein the mass % is based on the total mass of the multifilament strand;

b) applying from 0.5 to 20% by mass of an impregnating agent to said at least one continuous glass multifilament strand to form an impregnated continuous multifilament strand;

c) applying a sheath of thermoplastic polymer around the impregnated continuous multifilament strand to form a composite strand, being a sheathed continuous multifilament strand.

In an embodiment of said third aspect, the composite strand is a strand, of long glass fiber-reinforced thermoplastic polymer composition, and step I) of preparing a composite strand comprises the subsequent steps of:

a2) providing a plurality of continuous fibers, applying a sizing composition to coat substantially all of said plurality of fibers provided, and gathering said plurality of sized glass fibers to obtain a sized continuous glass multifilament strand containing at most 2% by mass of said sizing composition wherein the mass % is based on the total mass of the multifilament strand);

b) applying from 0.5 to 20% by mass of an impregnating agent to said at least one continuous glass multifilament strand to form an impregnated continuous multifilament strand;

c) applying a sheath of thermoplastic polymer around the impregnated continuous multifilament strand to form a composite strand, being a sheathed continuous multifilament strand.

Hence the present method relates in an embodiment of the third aspect to a method wherein step I) comprises the steps of:

i) providing a plurality of continuous fibers;

ii) applying a sizing composition to coat substantially all of said plurality of fibers provided in step i)

iii) gathering said plurality of sized glass fibers obtained in step ii) to obtain a preimpregnated continuous glass multifilament strand containing between 2 and 25% by mass of said sizing composition;

iv) applying a sheath of thermoplastic polymer around the preimpregnated continuous multifilament strand to form a sheathed, composite strand: and wherein step II) is carried out using a cutting module according to the invention and step II) comprises the steps of:

A) counter-rotating the cot wheel and the cutter wheel of the cutting module;

B) feeding the sheathed, composite strand between the cutter wheel and the cot wheel, and C) cutting the sheathed, composite strand into individual pieces.

Hence the present method relates in an embodiment of the third aspect to a method wherein step I) comprises the steps of:

a1) unwinding from a package of at least one continuous glass multifilament strand containing at most 2% by mass of a sizing composition or a2) providing a plurality of continuous fibers, applying a sizing composition to coat substantially all of said plurality of fibers provided, and gathering said plurality of sized glass fibers to obtain a sized continuous glass multifilament strand containing at most 2% by mass of said sizing composition);

b) applying from 0.5 to 20% by mass of an impregnating agent to said at least one continuous glass multifilament strand to form an impregnated continuous multifilament strand;

c) applying a sheath of thermoplastic polymer around the impregnated continuous multifilament strand to form a composite strand, being a sheathed continuous multifilament strand; and wherein step II) is carried out using a cutting module according to the invention and step II) comprises the steps of:

A) counter-rotating the cot wheel and the cutter wheel of the cutting module;

B) feeding the sheathed, composite strand between the cutter wheel and the cot wheel, and C) cutting the sheathed, composite strand into individual pieces.

In an embodiment, as said fibers glass fibers are used and as said sheathing material polypropylene is used to obtain a composite material having a core comprising a continuous glass multifilament strand and a sheath of polypropylene surrounding said core, preferably said composite material having a strand diameter in the range of 2.5 to 4.5 mm and/or a individual piece length in the range of 5 to 40 millimeter.

According to an aspect, a cutting module is provided for cutting a strand into individual pieces, the cutting module comprising a rotatable cutter wheel and a rotatable cot wheel, the cutter wheel being rotatable about a cutter wheel central rotational axis, and having a plurality of cutting blades, spaced apart in circumferential direction of the cutter wheel and each extending in an axial direction, each of the plurality of cutting blades having a front surface, facing forward in a direction of rotation of the cutter wheel in use, and a rear surface, at an acute tip angle with the front surface, facing rearward in the direction of rotation in use, an intersection of the front and rear surfaces defining a cutting edge, the cot wheel having a cylindrical outer surface and being rotatable about a cot wheel central rotational axis extending parallel at a distance from the cutter wheel rotational axis, such that the plurality of cutting edges of the cutting blades contact the outer surface of the cot wheel successively in use, so that a strand which is fed between the cutter wheel and the cot wheel is cut into individual pieces, wherein each of the plurality of cutting blades points forward, over a forward angle (f), in the direction of rotation of the cutter wheel in use.

In an embodiment, each of the plurality of cutting blades being designed such that a cutting force (Fc) is directed through the cutting blade in use.

According to an aspect, a cutting module is provided for cutting a strand into individual pieces, the cutting module comprising a rotatable cutter wheel and a rotatable cot wheel, the cutter wheel being rotatable about a cutter wheel central rotational axis, and having a plurality of cutting blades, spaced apart in circumferential direction of the cutter wheel and each extending in an axial direction, each of the plurality of cutting blades having a front surface, facing forward in a direction of rotation of the cutter wheel in use, and a rear surface, at an acute tip angle with the front surface, facing rearward in the direction of rotation in use, an intersection of the front and rear surfaces defining a cutting edge, the cot wheel having a cylindrical outer surface and being rotatable about a cot wheel central rotational axis extending parallel at a distance from the cutter wheel rotational axis, such that the plurality of cutting edges of the cutting blades contact the outer surface of the cot wheel successively in use, so that a strand which is fed between the cutter wheel and the cot wheel is cut into individual pieces, wherein each of the plurality of cutting blades points forward, over a forward angle (f) in the range of 3 to 10 degrees in the direction of rotation of the cutter wheel in use; wherein the tip angle is in the range of 20 to 40 degrees; and wherein the distance between the cutter and cot wheel is chosen such that in use the penetration depth is in the range of 0.3 to 2.5 millimeter.

More information about the components of said composite products, viz. the multifilament strands, the sizing composition, the impregnating composition (optional), and the sheathing material is provided below.

Multifilament Strands

The unsheathing multifilament strands function as a filler of the polymeric sheathing material. Both organic and inorganic fibers may be used such as synthetic organic fibers (e.g. polyamide, polytetrafluoroethylene, polyesters, silicon carbide), natural organic fibers (e.g. cotton, hemp, flax, jute), inorganic fibers (e.g. glass, graphite or carbon). The fibers are generally supplied as a plurality of continuous, very long filaments and can be in the form of strands, rovings or yarns and all are encompassed in the present invention when speaking of multifilament strands. A filament is an individual fiber, a strand is a plurality of bundled filaments; yarns a collections of filaments or strands twisted together and rovings refer to a collection of strands wound into a package. The present invention preferably uses continuous glass fibers in the form of a continuous multifilament strand.

A plurality of glass fibers is generally drawn from a glass melt, e.g. through a bushing of orifice plate. The present invention may be used in-line, viz. the drawn fibers are directly used in the subsequent step, or may be used off-line wherein multifilament strands (optionally after sizing—see below) that are pre-manufacture and stored by winding them in packages, e.g. on wheels or bobbins.

Sizing Composition

Applying a sizing composition to (glass) filaments is well-known in the art. Conventional sizing composition may comprise solvent-based compositions, melt-based compositions and radiation cure-based compositions. The preferred type is solvent-based composition. Preferably, using water as the solvent.

The sizing composition may be used to size or to preimpregnate the plurality of glass fibers (depending in the amount that is used).

An aqueous sizing composition may typically include film formers, coupling agents and other components. Documents EP1 460 166, EP 0 206 189 and U.S. Pat. No. 4,338,233 disclose examples of aqueous sizing compositions and the information regarding those composition is incorporated by reference. The film forming agents are generally present to protect the fibers from interfilament abrasion and to provide integrity and processability of the fibers strands after they have dried. More information about the film forming agents can be found in WO2009/080281 on page 7, lines 21-29 and WO98/06551 page 20, lines 19-27 which sections are fully incorporated by reference herein. The coupling agents are generally used to improve the adhesion between the polymeric sheathing composition and the fibers. More information about the coupling agents can be found in WO2009/080281 on page 7, line 31 to page 8, line 9 and WO98/06551 page 24, line 9 to page 26, line 29 which sections are fully incorporated by reference herein. More information about additional components of the sizing composition can be found in WO2009/080281 on page 8, lines 10-14 and in WO98/06551 page 27, line 27 to page 29, line 10, which sections are fully incorporated by reference herein.

The amount of sizing agents depends on the desired use. In case the sizing composition is used merely to size the fibers of the multifilament strand, e.g. in case the multifilament strand is further impregnated, the amount may be at most 2% by mass, preferably at least 0.1% by mass, more preferably at least 0.5% by mass, wherein the mass % is based on the total mass of the multifilament strand; more information can be found in WO2009/080281 on page 8, lines 16-25 which section is fully incorporated by reference herein. A conventional Loss on Ignition (LOI) as disclosed in WO2009/080281 and WO98/06551 may be used to determine the amount of sizing agent.

The sizing may be applied by an applicator directly after drawing of the fiber to use the heat of the still hot fiber to (party) cure the sizing. More information can be found in WO98/06551 on page 12, lines 4-31 which section is fully incorporated by reference herein.

The sizing composition preferably having been applied as an aqueous dispersion and preferably comprising an aminosilane compound.

Impregnating Composition

After the sizing, the multifilament strand may be provided with an impregnating composition, this may be added in an amount of between 0.5 and 20% by mass of impregnating agent to the multifilament strand(s). The amount is based on the total mass of the multifilament strand. A conventional Loss on Ignition (LOI) as disclosed in WO2009/080281 and WO98/06551 may be used to determine the amount of sizing agent.

The impregnating agent preferably being non-volatile, having a melting point of at least 20 degrees C. below the melting point of the thermoplastic matrix, having a viscosity of from 2.5 to 100 cSt at application temperature, and being compatible with the thermoplastic polymer to be reinforced. The impregnating agent preferably comprising a highly branched poly(alpha-olefin). The impregnating agent is preferably at least one compound that is compatible with the sheathing material to be reinforced by the at least one multifilament strand; this enables dispersion the strand(s) in the polymer sheath during the moulding process.

More information about the step of applying said impregnating agent can be found in WO2009/080281 on page 9, lines 14-30 which section is fully incorporated by reference herein.

The kinematic viscosity of said impregnation composition is preferably lower than 100 cSt. The kinematic viscosity is measured according to the method disclosed in ISO 3104: 1994. More information about the viscosity of the impregnating agent can be found in WO2009/080281 on page 10, lines 6-18 which section is fully incorporated by reference herein. More information about the melting point of the impregnating agent can be found in WO2009/080281 on page 10, lines 20-29 which section is fully incorporated by reference herein.

The impregnating agents depends on the selection of the sheathing agents, viz. it should be matched to the desired sheathing agent. More information about this impregnating agent can be found in WO2009/080281 on page 10, line 32 to page 13, line 1-9 which section is fully incorporated by reference herein.

Suitable examples of impregnating agents are low molar mass compounds. As a general rule polar thermoplastic polymer sheathing compositions require the use of an impregnating agent containing polar functional groups and non-polar thermoplastic polymer sheathing composition involve impregnating agents having a non-polar character.

Sheathing Composition

As known in the art, a sheathing or matrix may be applied around a continuous strand for several reasons, for example to protect the strand from external elements, to strengthen the strand and to provide a particular composite material for subsequent processing into molded articles. Suitable examples of sheathing materials for the sheathing composition include polyamides, polyolefins, polyesters, polycarbonates, polyphenylene sulfide, polyurethanes, and any type of polymer blend and compounds and combinations thereof. More information about this sheathing compositions and optional additives can be found in WO2009/080281 on page 13, line 14 to page 14, line 4 which section is fully incorporated by reference herein. The thermoplastic polymer preferably being a polypropylene.

The sheathing material may also comprise one or more fillers and additives, such as between 1 and 40% by mass of the sheathing composition of fillers, such as carbon black, and preferably at most 5% by mass of the sheathing composition of additives, such as stabilizers and/or functionalized polyolefins.

The sheath may be applied by any method known in the art that is suitable to that end. The sheathing may comprise a wire-coat process involving the application of a polymer layer on the outer surface of the one or more multifilament strand as it passes through the polymer melt in a die. More information about this process can be found in EP 0 921 919 and EP 0 994 978 which are incorporated by reference. More information can also be found in WO98/06551 on page 13, lines 5-21 which section is fully incorporated by reference herein.

In one specific embodiment of the present invention all steps are carried out in line, being the drawing of the fibers, the application of the sizing, the optionally application of the impregnation, the application of the sheathing, and the cutting into individual pieces. The advantage of this full in-line process is that no storage is require and hence no reeling of strands onto bobbins and so on.

An additional step is possible after the application of the sheath, being cooling the composite strand formed, e.g. by pulling the composite strand through a cooling liquid, such as water. By determining the temperature of the cooling liquid, its cooling capacity as well as the duration of cooling the final temperature of the composite strand may be tuned; this is also dependent on the amount of multifilament strand and on the sheathing composition. An advantage of this cooling step is that the strands retain their shape because the sheathing composition crystallizes upon cooling. However, when the composite strands are cooled too much, i.e. the temperature is too low when the composite strand is cut, this will increase the wear of the cutter. An optimum should be reached which depends on the material of the sheathing and can be deducted by the person skilled in the art. In addition, the composite strand does not stick to the cutter and/or cot wheel or is deformed in the cutting process.

An additional step is possible after the cooling step, being a drying step wherein the cooled composite strand is cooled, e.g. by ventilation by air, such as by an air knife (high volume air blower). An advantage of this drying step is that the moisture level can be controlled to ensure that the strand will not stick to the cutter and/or cot wheel.

Composite Strand

The composite strand comprises one or more multifilament strands that for the reinforcing filler and a sheathing composition that forms the matrix of said composite strand. When one multifilament strand is used this may form a central core surrounded by the sheathing composition. When more than one multifilament strands are used, they may be dispersed through the cross section of the composite strand, being surrounded by the sheathing composition that is also present in between the multiple multifilament strands The composite strand may for example be prepared by a pultrusion process or by a wire-coat process, wherein a wire-coat process is the preferred process; an example of a preferred wire-coat process is disclosed in WO2009/080281, which is incorporated by reference.

In the composite strand, the multifilament strand (including any sizing and/or impregnation) may form between 30 and 70% by mass of the total composite, such as 40% or 50% or 60%, the rest being formed by the polymeric sheath.

Pieces of Composite Product

According to the present invention, the composite strand is cut into individual pieces using a cutter module according of the invention. In an embodiment, the length of the cut pieces are between 5 and 40 millimeter, preferably between 10 and 30 millimeter. Preferably, substantially all, preferably at least 90% of the cut pieces has the same or a very similar length, viz. the variation in length of the individual pieces is between +10% and −10% of the mathematically average length of the individual pieces, preferably between +5% and −5%. For example, when the average length of the individual pieces is 15 mm, than preferably at least 90% of the pieces has a length between 13.5 and 16.5 mm, preferably between 14.25 and 15.75 millimeter.

The individual pieces may be processed by any suitable technique, such as injection molding, extrusion, or compression molding into (molded) objects.

According to the present teachings a cutting module is provided, for cutting a strand into individual pieces, the cutting module comprising a rotatable cutter wheel and a rotatable cot wheel, the cutter wheel having cutting blades, the cot wheel having a cylindrical outer surface and being parallel at a distance from the cutter wheel, such that cutting edges of the cutting blades contact the outer surface of the cot wheel successively in use, so that a strand which is fed between the cutter wheel and the cot wheel is cut into individual pieces, each of the cutting blades being designed such that a cutting force is directed through the cutting blade.

After the cutting an additional step of sieving may be carried out to remove any uncut pieces or partly cut pieces from the individually cut pieces that are desired. The individually cut pieces may be collected and stored for transport.

BRIEF DESCRIPTION OF DRAWINGS

The present teachings are described hereinafter with reference to the accompanying drawings in which embodiments of the invention are shown and in which like reference numbers indicate the same or similar elements.

DESCRIPTION OF EMBODIMENTS

Figure 1:
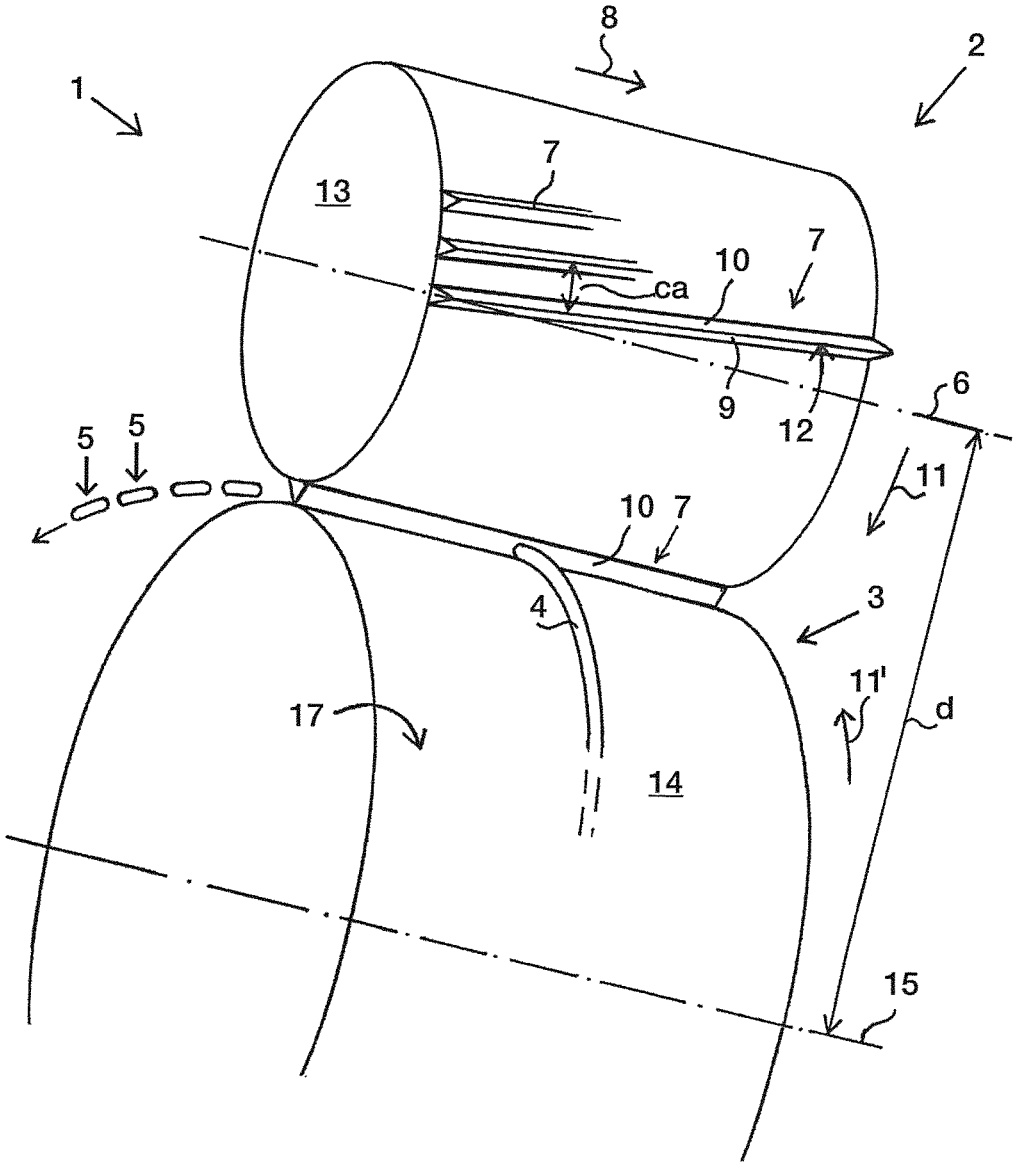
FIG. 1 shows an example of a cutting module according to the present teachings, in 3-dimensional view.

FIG. 1 illustrates a cutting module 1 having a cutter wheel 2 and a cot wheel 3. In use, the module cuts a strand 4, partly shown, of long glass fibre reinforced polypropylene having a core comprising a continuous glass multifilament strand and a sheath surrounding said core, into individual pieces 5, or, granules. The strand is continuously fed between the cutter wheel 2 and the cot wheel 3 from a source of strand, such as a from a supply roll, or from a preceding in-line processing device such as a device arranged for applying a sheath of thermoplastic polymer around an impregnated continuous multifilament strand to form the, composite, strand, being a sheathed continuous multifilament strand. In practice a plurality of such strands are fed simultaneously, distributed over the length of the module 1, in axial direction 8, between the cutter wheel 2 and the cot wheel 3.

The cutter wheel 2 is rotatable about a cutter wheel central rotational axis 6 and it has a plurality of cutting blades 7, spaced apart in circumferential direction of the cutter wheel 2 and each extending in the axial direction 8. Only two blades 7 are fully shown in FIG. 1. The cutting blades 7 are provided on a base 13 of the cutter wheel 2. As shown in FIG. 1, the cutting blades 7 may extend in the axial direction under a slight helical angle with respect to the axial direction as shown in FIG. 1. Due to this, the cutting blades 7 are twisted over the length thereof, wherein the amount of twist depends on the length of the cutter wheel 2 and thus also on the length of the cutting blades 7. This way, at each point along the length of the cutter wheel 2, the cutting blades are directed exactly in the same direction such as relating to the forward angle thereof as will be explained in more detail below.

Figure 2:
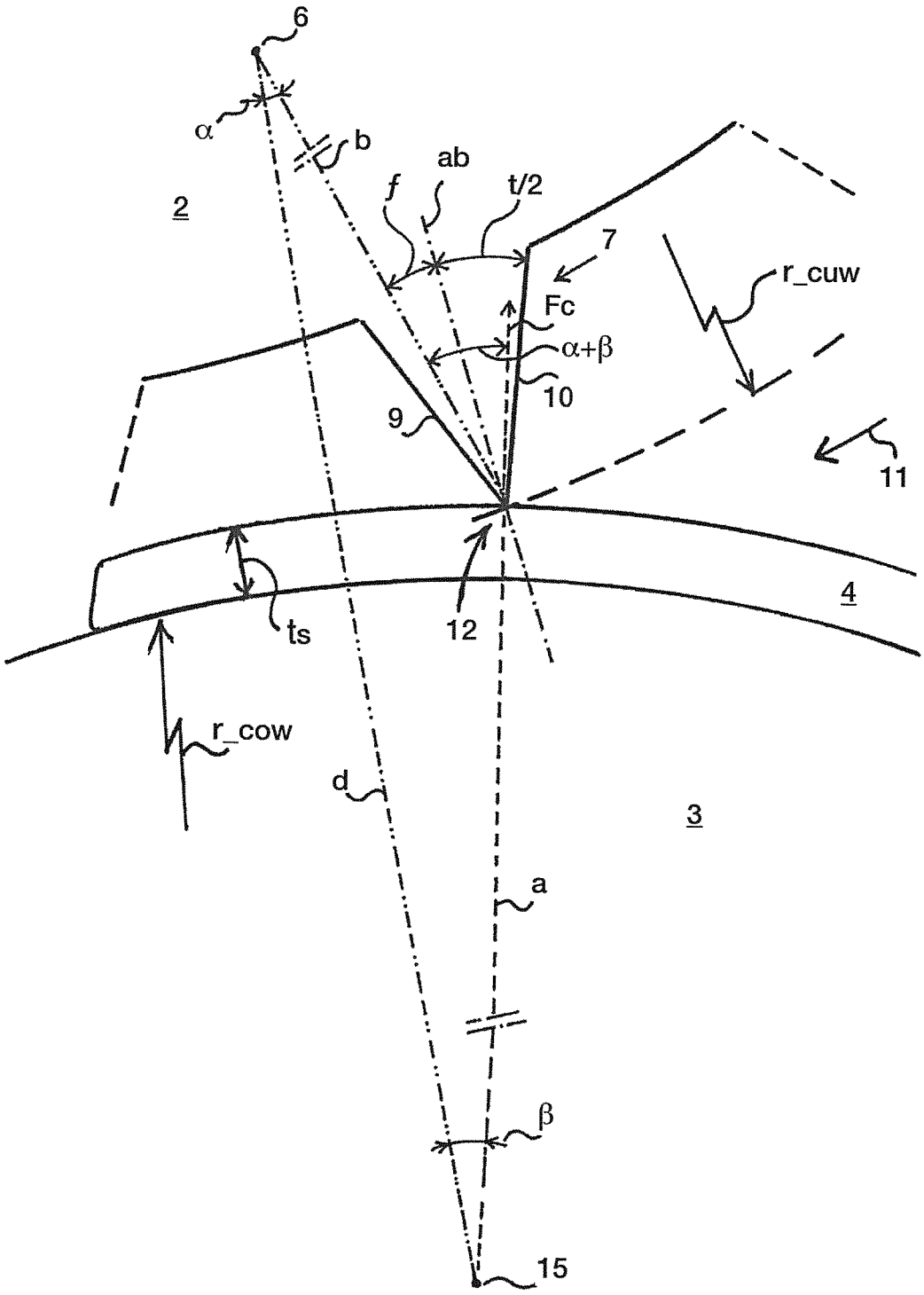
FIG. 2-4 shows, in cross-section, a sketch of part of the module of FIG. 1, also showing a part of a strand being cut into individual pieces, for the purpose of describing a method of designing a cutting blade of the cutting module, FIGS. 2-4 showing three consecutive states during the cut of a strand: the state on entry of a cutting blade into the strand (FIG. 2); an intermediate state (FIG. 3); and the state on exit of a cutting blade at the end of the cut through the strand (FIG. 4).
Figure 5:
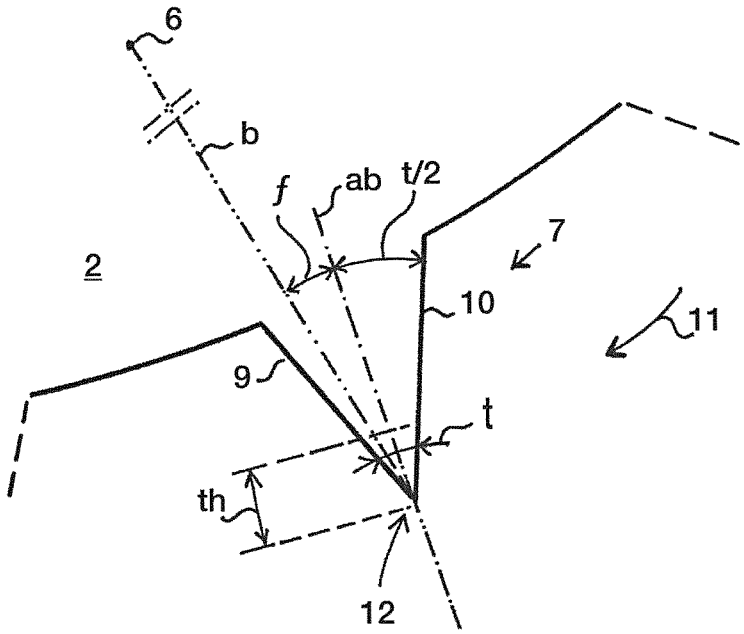
FIG. 5 shows part of FIG. 2, including some additional reference signs, for further clarification.

Each of the plurality of cutting blades 7 has a front surface 9, facing forward in a direction of rotation 11 of the cutter wheel 2 in use, and a rear surface 10, at an acute tip angle t with the front surface 9, facing rearward in the direction of rotation 11 in use. In FIG. 2 the half tip angle (t/2) is indicated. See also FIG. 5. The tip angle is the angle of the tip, which is the acute angle between the relevant parts of the front 9 and rear surfaces 10 of the cutting blade 7, defining the cutting edge 12 at the intersection thereof. The relevant parts of the front and rear surfaces are the parts in vicinity of the cutting edge, such as in the range up to 1 mm, 2 mm or even 3 mm from the cutting edge. This distance of for example 3 mm is indicated by the reference sign th in FIG. 5. In case of a cutting blade having flat front and rear surfaces, the value of th is irrelevant. In case that the cutting blade would however have a bullet-shape for example, i.e. having curved front and rear surfaces, the tip angle may still be well-defined using the mentioned distance.

An angle bisector line ab divides the tip angle t in half. An intersection of the front and rear surfaces 9, 10 defines a cutting edge 12. The cutter wheel 2 has a cutter wheel radius r_cuw which is defined by a circumscribed circle (indicated by a dashed line in FIG. 2) of the cutting edges 12. The cutting blades 7 are made of tungsten carbide but may alternatively be made of, or comprise, other suitable materials such as High Speed Steel or ceramic materials. The number of cutting blades 7 on the cutter wheel depends on the radius of the cutter wheel and on the mentioned circular arc between cutting edges of individual cutting blades.

The cot wheel 3 has a cylindrical outer surface 14 and it is rotatable about a cot wheel central rotational axis 15 extending parallel at a distance d from the cutter wheel rotational axis 6. The distance d is chosen such that the plurality of cutting edges 12 of the cutting blades 7 contact the outer surface 14 of the cot wheel 3 successively in use, so that a strand 4 which is fed between the cutter wheel 2 and the cot wheel 3 is cut into individual pieces 5, or, granules. The cot wheel 3 has a cot wheel radius r_cow defined by the cylindrical outer surface 14 of the cot wheel 3. The cot wheel 3 further has a resilient layer 17 at least at the outer surface 14. The distance d between the cutter wheel rotational axis 6 and the cot wheel rotational axis 15 is such that the respective cutting edges 12 of the cutting blades 7 of the plurality of cutting blades successively deform and penetrate the resilient layer 17 of the cot wheel 3. The resilient layer 17 of the cot wheel 3 is made of an elastomeric polyurethane. As a result of the fact that the cutting blades 7 of the cutter wheel 2 engage the cot wheel 3, in use the cot wheel 3 rotates in a direction 11' opposite to the direction of rotation 11 of the cutter wheel. The cot wheel 3, or alternatively the cutter wheel 2 or both, may be rotatably driven by any drive means such as by an electric motor. The cutter wheel 2 is then rotated via the cot wheel 3.

Each of the plurality of cutting blades 7 points forward, over a forward angle f, in the direction of rotation 11 of the cutter wheel 2 in use. The forward angle f is the angle between the angle bisector line ab and a mathematical base line, coinciding with line b in FIG. 2, intersecting the rotational axis 6 and the cutting edge 12.

A method of designing a cutter wheel of a cutting module having cutting blades pointing forward over a forward angle, according to the present teachings, comprises the steps of:

- defining the cutter wheel radius r_cuw and the cot wheel radius r_cow, the distance d between the cutter wheel and the cot wheel, and the strand thickness;
- for each of the cutting blades, for one or more values of a tip angle t of each of the plurality of cutting blades:
  - calculating a minimum forward angle f based on an entry point of the cutting edge of the cutting blade, at the start of a cut through the strand, and
  - calculating a maximum forward angle f based on an exit point of the cutting edge of the cutting blade, at the end of a cut through the strand.

Reference is made to FIG. 2, in which a cutting blade 7 of the plurality of cutting blades is cutting through a strand 4, or at least is in a state wherein the cutting blade 7 is making a first contact with the strand, i.e. the entry point. The above step of calculating a minimum forward angle f of the plurality of cutting blades may be performed by applying the cosine rule (also called the law of cosines) on a triangle having as sides the distance d between the cutter wheel 2 and cot wheel 3, a line b between the cutter wheel rotational axis 6 and the cutting edge 12 of the cutting blade 7, the length of which line b thus equals the cutter wheel radius r_cuw, and a line a between the cot wheel rotational axis 15 and the cutting edge 12, the length of which equals a cutting edge radius r_ce, at the entry point. The radius r_ce is in this case equal to the cot wheel radius r_cow plus the strand thickness t_s. Here, the angles alpha and beta are calculated using the cosine rule on the mentioned triangle; the line a coincides with the cutting force Fc, illustrated as a vector; and the line b coincides with the above mentioned mathematical base line.

Figure 3:
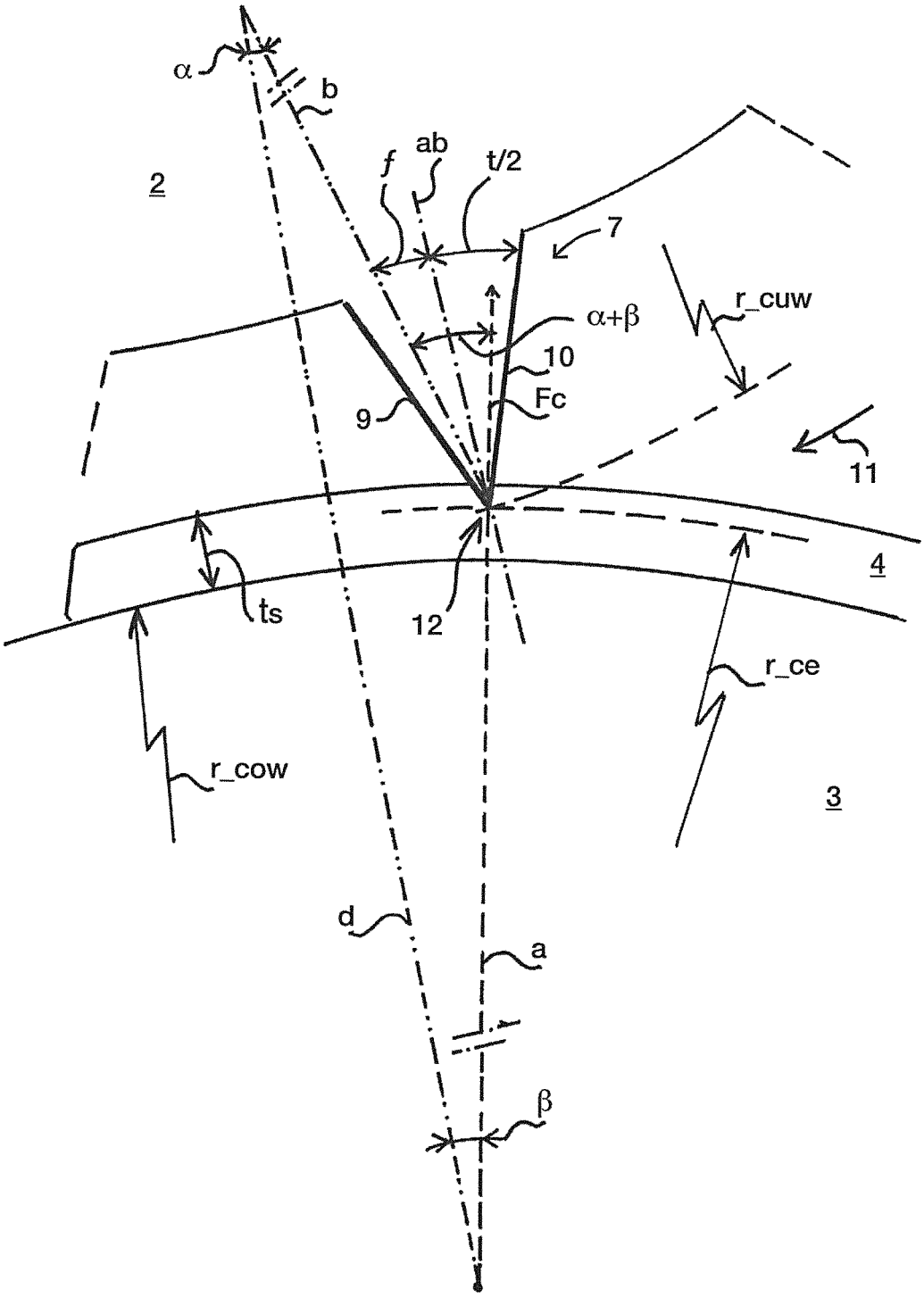

From the entry point, the cutting blade 7 cuts through the strand 4. FIG. 3 shows an intermediate state during the cut.

Figure 4:
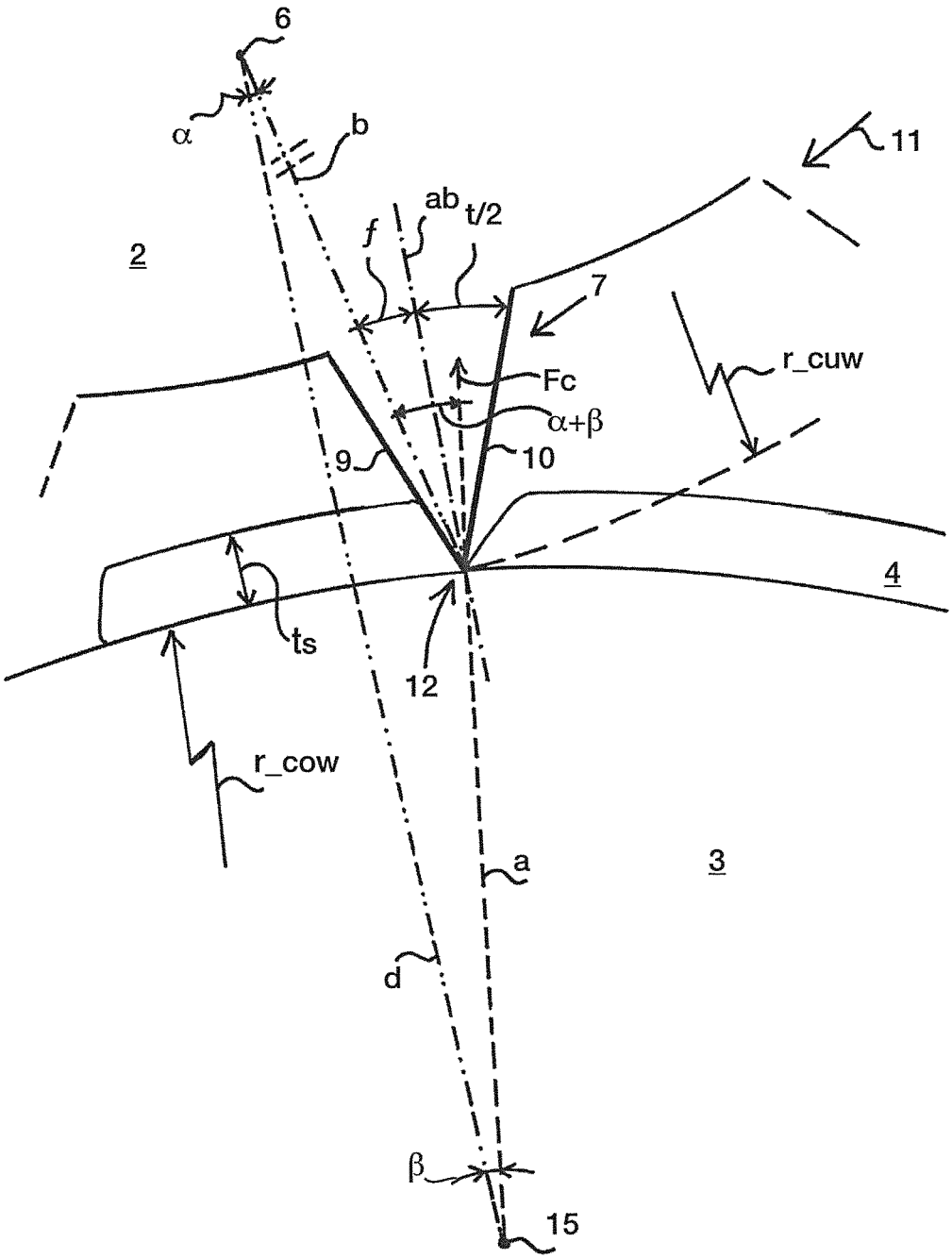

The above step of calculating a maximum forward angle f of the plurality of cutting blades may be performed by applying again the cosine rule on the triangle having as sides the distance d between the cutter wheel 2 and cot wheel 3, the line b, and the line a, but this time at the exit point, upon finish of the cut, or, at the exit point, as shown in FIG. 4. The length of a is in this case considered equal to the cot wheel radius r_cow.

In case that the outcome of the above calculations show that the value of the minimum forward angle is larger than the value of the maximum forward angle, the tip angle needs to be increased until the value of the minimum forward angle is at most equal to the value of the maximum forward angle.

In an embodiment of the method, for the purpose of designing a cutting module of which in use the cutting force vector is at an acute angle of at least a predefined value (in degrees; the value representing a safety angle sf) with the bisector line ab as well as with the rear surface 10 at all times, sf should be added to the value of the minimum forward angle and be subtracted from the value of the maximum forward angle. For example, sf may be in the range of 0.5 to 2 degrees, such as for example 1 degree. See also FIG. 8.

Example 1

Figure 7:
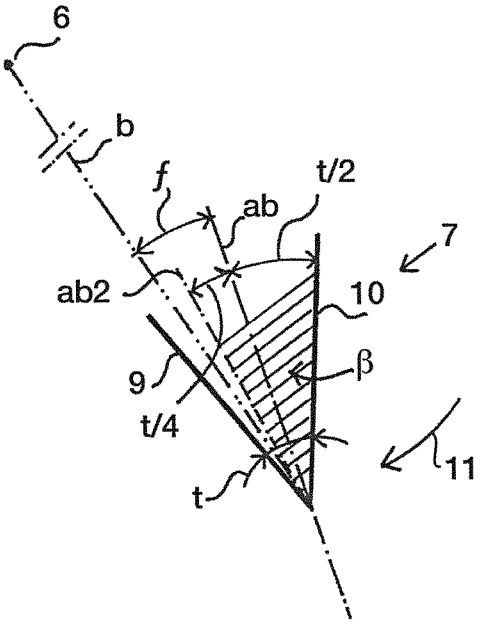

In the present example, each of the plurality of cutting blades has been designed such that a cutting force (Fc) is directed through the rear three quarters of the cutting blade. That means, a cutting force (Fc) is directed between an angle bisector line (ab2) of a front half angle between the front surface of the cutting blade and the angle bisector line (ab) of the tip angle of the cutting blade, and the rear surface of the cutting blade. This part of the cutting blade is indicated by the hatched area B in FIG. 7.

The radius r_cuw is 80 mm in the present example. The plurality of cutting blades 7 are spaced apart in circumferential direction of the cutter wheel 2 such that a circular arc ca between two successive cutting edges 12 (see FIG. 1) is 12 mm. The tip angle t of the cutting edge is 25 degrees. The number of cutting blades 7 on the cutter wheel depends on the radius of the cutter wheel and on the mentioned circular arc between cutting edges. In the present example, about 41 cutting blades 7 may be provided. The cot wheel radius r_cow is 300 mm. A penetration depth of the respective cutting edges 12 into the resilient layer 17 of the cot wheel 3 is 0.6 mm; that means that the distance between the rotational axes 6, 15 of the cutter and cot wheel is set at 379.4 mm.

The entry of the cutting blade into the strand (FIG. 2) determines the minimum value of the forward angle. The forward angle f is at least equal to the angle alpha ($\alpha$) between d and b, plus the angle beta ($\beta$) between d and a, minus half the tip angle i.e. t/2. Thus, $f \geq alpha+beta-t/2$.

The exit of the cutting blade from the strand (FIG. 4) determines the maximum value of the forward angle. In the present example, the forward angle f is at most equal to the angle alpha between d and b plus the angle beta between d and a plus one fourth of the tip angle t. Thus, $f \leq alpha+beta+t/4$.

For the present example, the forward angle f is calculated in accordance with the above described designing method, for a strand having a diameter, or, thickness, of 3.5 mm, and not taking account a safety angle sf. This method results in a minimum forward angle of about 8.2 degrees and a maximum forward angle of about 14.1 degrees. If the forward angle would then be fixed at 10 degrees, for example, a safety angle of about 1.8 degrees on entry and a safety angle of about 4.1 degrees on exit would result. Also, choosing a different value of the tip angle t would result in different values for the minimum and maximum forward angle. This means that several suitable combinations of tip angle and forward angle may result from the calculations. The same holds for the further examples below.

Example 2

Figure 6:
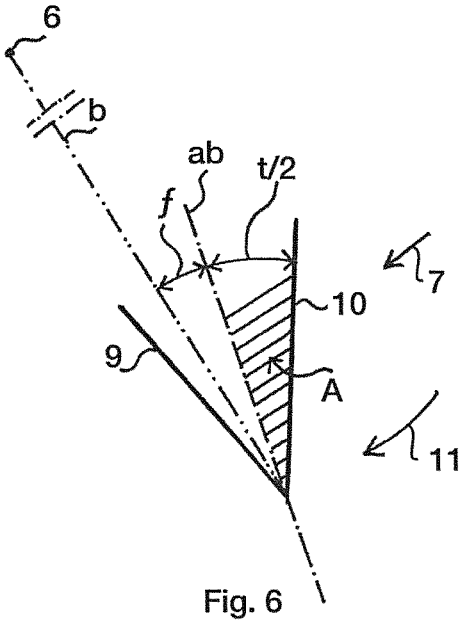
FIGS. 6-8 show, in cross-section, a single cutting blade including areas thereof through which a cutting force vector extends in use, of several respective embodiments of a cutting module according to the invention.

In the present example, each of the plurality of cutting blades 7 is designed such that a cutting force Fc, generated while a cutting blade 7 cuts through the strand 4, is directed through the rear half of that cutting blade 7, that means between an angle bisector line ab of the tip angle t and its rear surface 10. This part of the cutting blade is indicated by the hatched area A in FIG. 6.

The radius r_cuw is 81.25 mm in the present example. The plurality of cutting blades 7 are spaced apart in circumferential direction of the cutter wheel 2 such that about 36 cutting blades may be provided. The tip angle t of the cutting edge is 30 degrees. The cot wheel radius r_cow is 305 mm. A penetration depth of the respective cutting edges 12 into the resilient layer 17 of the cot wheel 3 is 0.5 mm; that means that the distance between the rotational axes 6, 15 of the cutter and cot wheel is set at 385.75 mm.

The entry of the cutting blade into the strand (FIG. 2) determines the minimum value of the forward angle. The forward angle f is at least equal to the angle alpha (α) between d and b, plus the angle beta (β) between d and a, minus half the tip angle i.e. t/2. Thus, f≥alpha+beta−t/2.

The exit of the cutting blade from the strand (FIG. 4) determines the maximum value of the forward angle. The forward angle f is at most equal to the angle alpha between d and b plus the angle beta between d and a. Thus, f≤alpha+beta.

In case that a minimum value for the safety angle would be required, The above step of calculating a minimum forward angle f of the cutting blades would then be f≥sf+alpha+beta−t/2. Similarly, the above step of calculating a maximum forward angle f of the cutting blades would then be f≤alpha+beta−sf.

Figure 8:
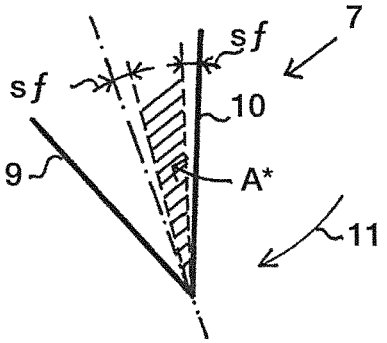

For the present example, the forward angle f is calculated in accordance with the above described designing method, for a strand having a diameter, or, thickness, of 3 mm, and not taking into account a (minimum) safety angle sf. This method results in a minimum forward angle of about 4 degrees and a maximum forward angle of about 7.1 degrees. If the forward angle would then be fixed at 5.5 degrees, for example, a safety angle sf of about 1.5 degrees on both sides would result. This situation is shown in FIG. 8, wherein the part of the cutting blade through which the cutting force Fc is directed from entry until exit is represented by the hatched area A*, being smaller than A because on both sides a safety angle sf is present. Although FIG. 8 shows an equal safety angle on both sides, different angles on the entry side (the right side in FIG. 8) and on the exit side (left side in FIG. 8) may be chosen, in dependence of the value of the forward angle and the tip angle. Such a safety margin may be advantageous because in that case variations such as in strand diameter/thickness may be accounted for without running the risk that the force vector Fc would be directed outside the rear half of the cutting blade. If such a safety angle would however not be desired, the cutting blade might be further optimized by decreasing the tip angle. A smaller tip angle leads to a lower load on the cutting blade during the cutting. If the tip angle would be set at about 23.7 degrees, the resulting minimum and maximum forward angles become about equal at about 7.1 degrees. In case that the minimum and maximum forward angles are equal, this means that on entry the cutting force vector coincides with the rear surface 10 of the cutting blade, whereas on exit the cutting force vector coincides with the angle bisector line ab.

Example 3

In the present example, each of the plurality of cutting blades 7 is, like in example 2, designed such that a cutting force Fc, generated while a cutting blade 7 cuts through the strand 4, is directed through that cutting blade 7, between an angle bisector line ab of the tip angle t and its rear surface 10.

The radius r_cuw is 75 mm in the present example. The tip angle t of the cutting edge is 32 degrees. The cot wheel radius r_cow is 320 mm. A penetration depth of the respective cutting edges 12 into the resilient layer 17 of the cot wheel 3 is 0.7 mm; that means that the distance between the rotational axes 6, 15 of the cutter and cot wheel is set at 394.30 mm.

The entry of the cutting blade into the strand (FIG. 2) determines the minimum value of the forward angle. The forward angle f is at least equal to the angle alpha (α) between d and b, plus the angle beta (β) between d and a, minus half the tip angle i.e. t/2. Thus, f≥alpha+beta−t/2.

The exit of the cutting blade from the strand (FIG. 4) determines the maximum value of the forward angle. The forward angle f is at most equal to the angle alpha between d and b plus the angle beta between d and a. Thus, f≤alpha+beta.

For the present example, the forward angle f is calculated in accordance with the above described designing method, for a strand having a diameter, or, thickness, of 4 mm, and not taking account a safety angle sf. This method results in a minimum forward angle of about 6.6 degrees and a maximum forward angle of about 8.7 degrees. If the forward angle would then be fixed at 7.65 degrees, for example, a safety angle of about 1.05 degrees on both sides would result.

The foregoing description provides embodiments of the invention by way of example only. The scope of the present invention is defined by the appended claims.

The invention claimed is:

1. A cutting module for cutting a strand into individual pieces, the cutting module comprising:

a rotatable cutter wheel and a rotatable cot wheel, the cutter wheel being rotatable about a cutter wheel central rotational axis, and having a plurality of cutting blades, spaced apart in circumferential direction of the cutter wheel and each extending in an axial direction, each of the plurality of cutting blades having a front surface, facing forward in a direction of rotation of the cutter wheel in use, and a rear surface, at an acute tip angle with the front surface, facing rearward in the direction of rotation in use, an intersection of the front and rear surfaces defining a cutting edge, the cot wheel having a cylindrical outer surface and being rotatable about a cot wheel central rotational axis extending parallel at a distance from the cutter wheel rotational axis, such that the plurality of cutting edges of the cutting blades contact the outer surface of the cot wheel successively in use, so that a strand which is fed between the cutter wheel and the cot wheel is cut into individual pieces, each of the plurality of cutting blades being designed such that a cutting force having a direction that coincides with a virtual line intersecting the cot wheel rotational axis and the cutting edge of a cutting blade in use while the cutting blade cuts through the strand is directed through the cutting blade in use, and each of the plurality of cutting blades being designed such that the cutting force is directed through the rear half of the cutting blade in use, the rear half being between an angle bisector line of the tip angle and the rear surface of the cutting blade.

2. The cutting module according to claim 1, wherein each of the plurality of cutting blades points forward, over a forward angle, in the direction of rotation of the cutter wheel in use, the forward angle being the acute angle between the angle bisector line of the tip angle of a cutting blade and a mathematical base line intersecting the rotational axis of the cutter wheel and the cutting edge.

3. The cutting module according to claim 2, wherein the forward angle of each of the plurality of cutting blades is in the range of 3 to 10 degrees.

4. The cutting module according to claim 1, wherein each of the plurality of cutting blades points forward, over a forward angle, in the direction of rotation of the cutter wheel in use, the forward angle being the acute angle between the angle bisector line of the tip angle of a cutting blade and a mathematical base line intersecting the rotational axis of the cutter wheel and the cutting edge, and wherein the forward angle of each of the plurality of cutting blades is in the range of 3 to 10 degrees.

5. The cutting module according to claim 1, wherein a cutter wheel radius, defined by a circumscribed circle of the plurality of cutting blades, is in the range of 20 to 35 percent of a cot wheel radius, defined by the cylindrical outer surface of the cot wheel.

6. The cutting module according to claim 1, wherein the tip angle of the cutting edge is in the range of 25 to 40 degrees.

7. The cutting module according to claim 1, wherein the cot wheel has a resilient layer at least at the outer surface which resilient layer made of an elastomeric material, and wherein the distance between the cutter wheel rotational axis and the cot wheel rotational axis is such that the respective cutting edges of the cutting blades of the plurality of cutting blades successively penetrate the resilient layer of the cot wheel.

8. A method of making a composite product comprising:

I) preparing a sheathed, composite strand; and

II) cutting the sheathed, composite strand into individual pieces using a cutting module according to claim 1.

9. Method according to claim 8, wherein step I) comprises:

i) providing a plurality of continuous fibers;

ii) applying a sizing composition to coat said plurality of fibers provided in step i)

iii) gathering said plurality of sized glass fibers obtained in step ii) to obtain a preimpregnated continuous glass multifilament strand containing between 2 and 25% by mass of said sizing composition;

iv) applying a sheath of thermoplastic polymer around the preimpregnated continuous multifilament strand to form a sheathed, composite strand; and wherein step II) comprises:

A) counter-rotating the cot wheel and the cutter wheel of the cutting module;

B) feeding the sheathed, composite strand between the cutter wheel and the cot wheel, and C) cutting the sheathed, composite strand into individual pieces.

10. Method according to claim 9, wherein said fibers are glass fibers and wherein said sheathing material is polypropylene so as to obtain a composite material having a core comprising a continuous glass multifilament strand and a sheath of polypropylene surrounding said core.

11. Method according to claim 8, wherein step I) comprises:

a1) unwinding from a package of at least one continuous glass multifilament strand containing at most 2% by mass of a sizing composition or a2) providing a plurality of continuous fibers, applying a sizing composition to coat said plurality of fibers provided, and gathering said plurality of sized glass fibers to obtain a sized continuous glass multifilament strand containing at most 2% by mass of said sizing composition);

b) applying from 0.5 to 20% by mass of an impregnating agent to said at least one continuous glass multifilament strand to form an impregnated continuous multifilament strand;

c) applying a sheath of thermoplastic polymer around the impregnated continuous multifilament strand to form a composite strand, being a sheathed continuous multifilament strand; and wherein step II) comprises:

A) counter-rotating the cot wheel and the cutter wheel of the cutting module;

B) feeding the sheathed, composite strand between the cutter wheel and the cot wheel, and C) cutting the sheathed, composite strand into individual pieces.

12. A cutting module for cutting a strand into individual pieces, the cutting module comprising:

a rotatable cutter wheel and a rotatable cot wheel, the cutter wheel being rotatable about a cutter wheel central rotational axis, and having a plurality of cutting blades, spaced apart in circumferential direction of the cutter wheel and each extending in an axial direction, each of the plurality of cutting blades having a front surface, facing forward in a direction of rotation of the cutter wheel in use, and a rear surface, at an acute tip angle with the front surface, facing rearward in the direction of rotation in use, an intersection of the front and rear surfaces defining a cutting edge, the cot wheel having a cylindrical outer surface and being rotatable about a cot wheel central rotational axis extending parallel at a distance from the cutter wheel rotational axis, such that the plurality of cutting edges of the cutting blades contact the outer surface of the cot wheel successively in use, so that a strand which is fed between the cutter wheel and the cot wheel is cut into individual pieces, wherein each of the plurality of cutting blades points forward, over a forward angle, in the direction of rotation of the cutter wheel in use, wherein the forward angle being the acute angle between the angle bisector line of the tip angle of a cutting blade and a mathematical base line intersecting the rotational axis of the cutter wheel and the cutting edge, wherein a cutter wheel radius, defined by a circumscribed circle of the plurality of cutting blades, is in the range of 20 to 35 percent of a cot wheel radius, defined by the cylindrical outer surface of the cot wheel, and wherein each of the plurality of cutting blades is designed such that a cutting force is directed through the rear half of the cutting blade in use, the rear half being between the angle bisector line of the tip angle and the rear surface of the cutting blade.

13. The cutting module according to claim 12, wherein the tip angle of the cutting edge is in the range of 25 to 40 degrees.

14. The cutting module according to claim 12, wherein the cot wheel has a resilient layer at least at the outer surface, and wherein the distance between the cutter wheel rotational axis and the cot wheel rotational axis is such that the respective cutting edges of the cutting blades of the plurality of cutting blades successively penetrate the resilient layer of the cot wheel.

15. A method of making a composite product comprising:

I) preparing a sheathed, composite strand; and

II) cutting the sheathed, composite strand into individual pieces using a cutting module according to claim 12.

16. A cutting module for cutting a strand into individual pieces, the cutting module comprising:

a rotatable cutter wheel and a rotatable cot wheel, the cutter wheel being rotatable about a cutter wheel central rotational axis, and having a plurality of cutting blades, spaced apart in circumferential direction of the cutter wheel and each extending in an axial direction, each of the plurality of cutting blades having a front surface, facing forward in a direction of rotation of the cutter wheel in use, and a rear surface, at an acute tip angle with the front surface, facing rearward in the direction of rotation in use, an intersection of the front and rear surfaces defining a cutting edge, the cot wheel having a cylindrical outer surface and being rotatable about a cot wheel central rotational axis extending parallel at a distance from the cutter wheel rotational axis, such that the plurality of cutting edges of the cutting blades contact the outer surface of the cot wheel successively in use, so that a strand which is fed between the cutter wheel and the cot wheel is cut into individual pieces, wherein each of the plurality of cutting blades points forward, over a forward angle in the range of 3 to 10 degrees in the direction of rotation of the cutter wheel in use;

wherein the tip angle is in the range of 20 to 40 degrees;

wherein the distance between the cutter and cot wheel is chosen such that in use the penetration depth is in the range of 0.3 to 2.5 millimeter; and wherein each of the plurality of cutting blades is designed such that the cutting force is directed through the rear half of the cutting blade in use, the rear half being between an angle bisector line of the tip angle and the rear surface of the cutting blade.

* * * * *